US006325324B1

(12) United States Patent
Getz et al.

(10) Patent No.: US 6,325,324 B1
(45) Date of Patent: Dec. 4, 2001

(54) TAPE SPLICING SYSTEM

(75) Inventors: John L. Getz, Blachley; Elvin Dalebout, Junction City, both of OR (US)

(73) Assignee: Industrial Adhesives, Inc., Eugene, OR (US)

( * ) Notice: Subject to any disclaimer, the term of this patent is extended or adjusted under 35 U.S.C. 154(b) by 0 days.

(21) Appl. No.: 09/398,153

(22) Filed: Sep. 16, 1999

(51) Int. Cl.[7] ..... B65H 19/18; B65H 21/00
(52) U.S. Cl. ..... 242/556.1; 242/555.2
(58) Field of Search ..... 242/555, 555.1, 242/555.2, 556.1; 156/504

(56) References Cited

U.S. PATENT DOCUMENTS 3,072,354 * 1/1963 Guiles et al. ..... 242/556.1 X
3,349,981 * 10/1967 Hawkins et al. ..... 226/181 X
3,645,463 * 2/1972 Helm ..... 242/556.1 X
4,262,855 * 4/1981 Haag ..... 156/504 X
4,917,327 * 4/1990 Asbury, Jr. et al. ..... 242/555 X
5,029,768 * 7/1991 Asbury, Jr. et al. ..... 242/555.1 X
5,323,981 * 6/1994 Dionne ..... 242/556.1
5,853,141 * 12/1998 Heiber et al. ..... 156/504 X

* cited by examiner

*Primary Examiner*—Michael R. Mansen
(74) *Attorney, Agent, or Firm*—Chernoff, Vilhauer, McClung & Stenzel, LLP

(57) ABSTRACT

An automatic tape splicer includes a block of metal that has a channel journalled into it to receive tape from first and second rolls. Adjacent to and protruding into the channel are first and second pinch rollers. Each roll of tape to be spliced includes a leading end and a trailing end. The leading end includes a portion having adhesive applied to one side which may be covered by release paper. The trailing end includes a reinforced portion which is thicker than the normal thickness of the tape. The channel is dimensioned such that the pinch rollers will press the trailing end of the tape against an adhesive-exposed leading end of the second roll of tape, splicing the two rolls together as the trailing end feeds through the channel engaging the sticky leading end of the second roll.

10 Claims, 2 Drawing Sheets

TAPE SPLICING SYSTEM

BACKGROUND OF THE INVENTION

The following invention relates to a system for splicing rolls of reinforcing tape together and more particularly to a continuous dispensing system for tape which permits uninterrupted operation in which the splicing of one roll of tape onto another occurs automatically.

Modern packaging frequently requires the use of reinforcing tape or tear tape to maintain the structural integrity of boxes, packages and/or containers. Such tape is fed out from a roll mounted on a spool or spindle in a continuous fashion. One problem in the industry is that the feed out of tape must be interrupted when a roll is depleted and a new roll must be inserted. In the past systems have been proposed that permit the uninterrupted dispensing of tape by fashioning a splice between the trailing end of one roll of tape and the leading end of another.

An example of a splicing system of this type may be found in U.S. Pat. No. 4,917,327 entitled TAPE DISPENSER. In this patent, the leading end of a roll of tape includes a loop element which mates cooperatively with a pin element at the trailing end of a second roll. The problem with this type of system is that the pin and loop combination creates an undesirable bulge in the tape at the splice point. It also introduces a foreign object, the pin, into the packaging to which the tape is applied. Other disadvantages of the pin and loop system are that the loop must be tied with a knot which can be either too tight or too loose. Additionally, there is the potential for an operator to get a finger caught or get cut by the running tape while making the splice.

SUMMARY OF THE INVENTION

The present invention provides an automatic tape splicer that avoids the aforementioned problems. The splicer is a block of metal that has a channel journalled into it to receive tape from first and second rolls. Adjacent to and protruding into the channel are first and second pinch rollers. Each roll of tape includes a leading end and a trailing end. The leading end includes a portion having adhesive applied to one side which may be covered by release paper. The trailing end includes a reinforced portion which is thicker than the normal thickness of the tape. The channel is dimensioned such that the pinch rollers will press the trailing end of the tape against an adhesive-exposed leading end of the second roll of tape, splicing the two rolls together as the trailing end feeds through the channel engaging the sticky leading end of the second roll. Otherwise the channel is wide enough for one roll of tape to feed through unimpeded while a new roll is being set up. The splicer also includes a pair of guide rollers for feeding each roll of tape into the channel To prepare the new roll for splicing, release paper is peeled off of the leading end of the new roll exposing an adhesive surface. This end is threaded into the channel. Next, the tape from the new roll is tacked down onto the guide roller to hold it in place temporarily. The splice will occur automatically when the thick trailing end of the first roll enters the channel and is pressed onto the exposed adhesive of the second roll by the pinch rollers.

The splicer of the invention may be provided as a retrofit device for an existing tape feed machine. The splicer is mounted on brackets that attach to fixtures such as support members or metal framing. The brackets have adjustment features that permit adjustment in both horizontal and vertical directions so that the splicer may be conveniently located between the rolls holding the tape rolls and the input to the tape feed machine.

DETAILED DESCRIPTION OF THE PREFERRED EMBODIMENT

Figure 1:
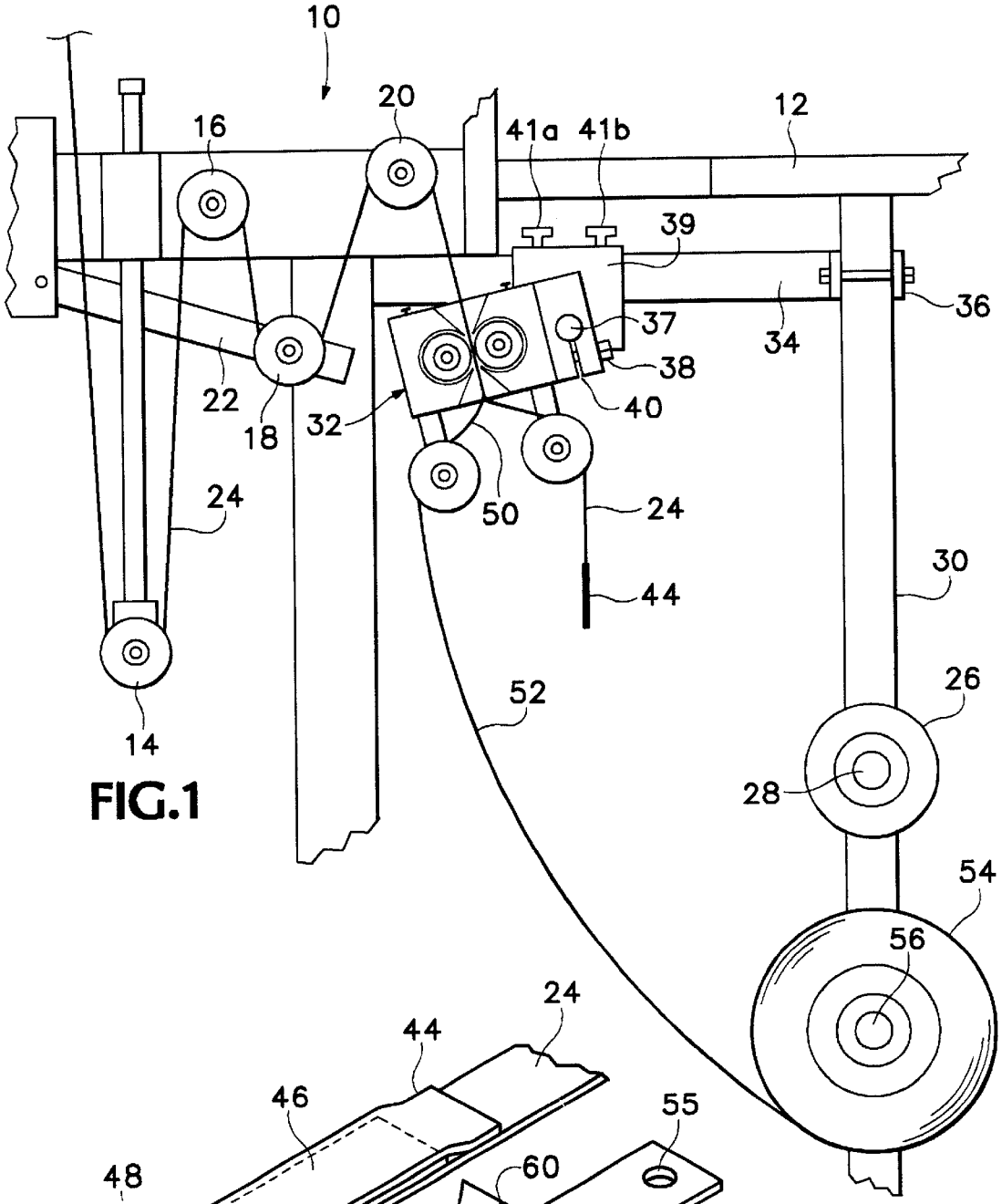
FIG. 1 is a side view of the splicer of the invention mounted to a frame feeding tape into a dispensing machine.

A tape dispensing machine 10 includes a frame 12 supporting guide rollers 14, 16, 18 and 20. A tensioning arm 22 adjusts the tension on tape 24 which has been completely fed out from a roll 26. The tape roll 26 is mounted on a spindle 28 which is in turn mounted on a vertical post 30, part of the frame 12. The tape dispensing machine 10 feeds out the tape for the application required and the particular form of this machine is not important for the purposes of this invention. The tape 24 may be any type of tape conventionally used in the packaging industry, such as corrugated reinforcing tape. The invention will work with other kinds of tape as well.

A splicer mechanism 32 is affixed to the fixture's vertical post 30 by a bracket arm 34. The bracket arm 34 has an adjustable clamp 36 which may be loosened to slide the whole assembly up or down the post thereby providing a vertical adjustment. The splicer mechanism 32 is mounted on a pin 37 that protrudes in a horizontal direction from a slidable bracket 39. The pin 37 may be an elongate member to provide a wide degree of lateral adjustment. A pair of pressure bolts 41*a* and 41*b* clamp the bracket 39 to the arm 34. The splicer 32 is clamped onto the pin 37 by a bolt 38 which pinches a keyway 40 to hold the splicer 32 at the desired angular orientation for proper feeding of the tape. Thus, the splicer 32 is adjustable in four degrees of freedom, vertically, horizontally, rotationally (about the pin) and horizontally (back and forth) on the pin itself.

Figure 2:
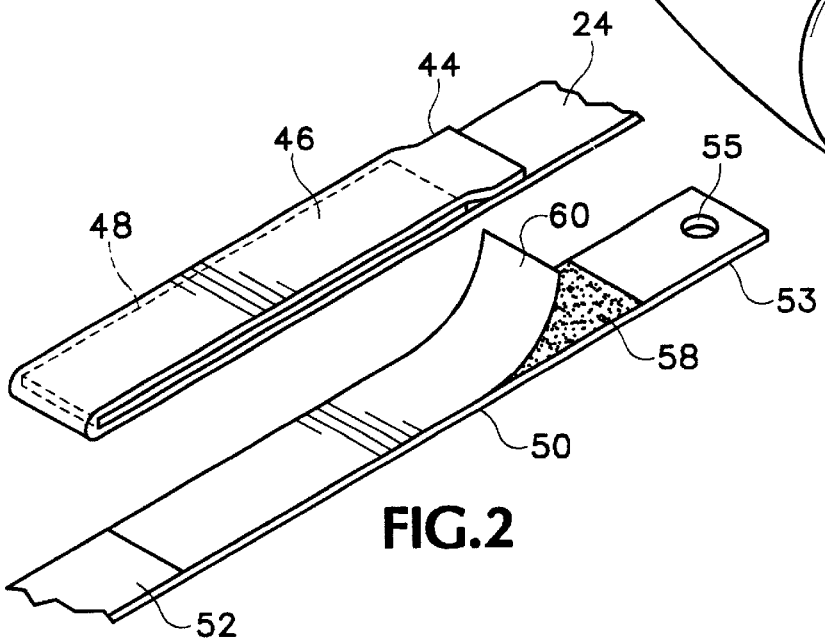
FIG. 2 is a perspective view of leading and trailing ends, respectively of first and second rolls of tape.

The tape 24 shown in FIG. 1 is depicted as having run off of its roll 26. The trailing end 44 of the tape 24 has a reinforced portion 46 shown in more detail in FIG. 2. The reinforced portion 46 is made by wrapping the end of the tape around a piece of cardboard or plastic 48. This makes the end portion 46 thicker than the tape as it comes off of the roll. Also shown in FIG. 2 is the leading end 50 of the tape 52. The tape 52 is shown in FIG. 1 as unrolling from a second roll of tape 54 mounted on a roll 56. The leading end 50 of the tape 52 has an adhesive applied to one side 58. The adhesive is covered by contact paper 60 which can be peeled away to expose the adhesive. The tape 52 has a short paper leader 53. The leader 53 is held onto the tape 52 by an adhesive. A grommet 55 is placed in the leader 53. The hole formed by the grommet 55 is placed over a pin 31 on the splicer 32 to hold the tape in preparation for splicing. A mirror image pin 31a is mounted on the opposite side of the splicer 32 because during the next splice, the leader will enter on the opposite side. It should be noted that both rolls of tape 26 and 54 have both leading and trailing ends as shown in FIG. 2.

Figure 4:
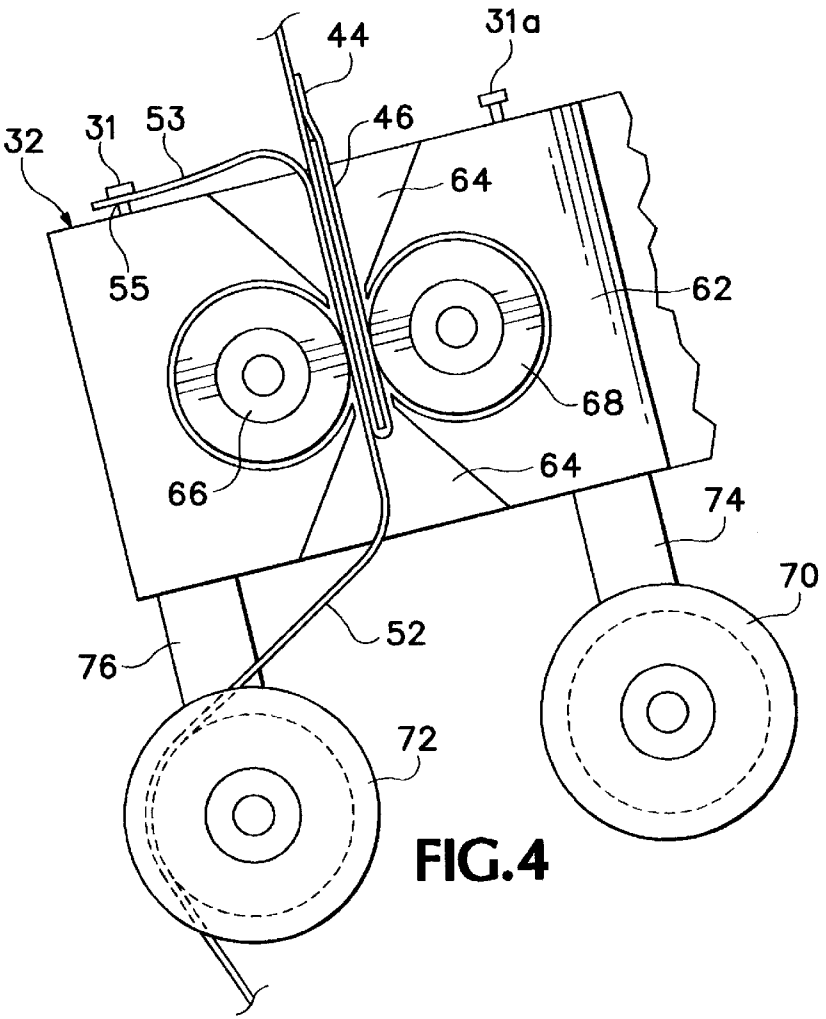
FIG. 4 is a partial side view of the splicer of FIG. 1 illustrating its operation as the thickened trailing end of the first roll engages the adhesive leading edge of the second roll.
Figure 3:
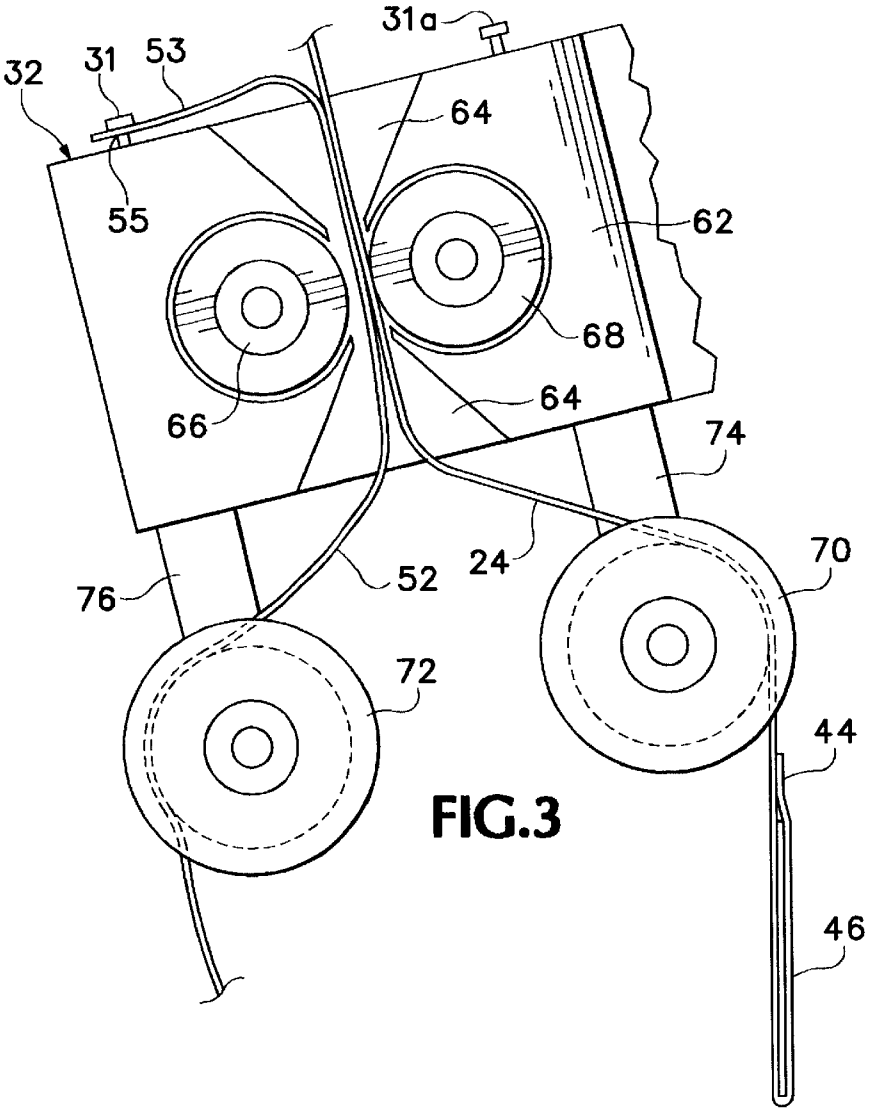
FIG. 3 is a partial side view of the splicer of FIG. 1 illustrating its operation just prior to a splice.

The splicer 32 and its operation are shown more fully in FIGS. 3 and 4. The splicer 32 is comprised of a metal block 62 having a wide, beveled center groove or channel 64 that receives tape from both rolls 54 and 26 as will be explained herein. Adjacent to and protruding slightly into the channel 64 at its narrowest point are pinch rollers 66 and 68. Pinch roller 68 is adjustable laterally to properly dimension the narrow neck of the channel. Below the channel 64 are a pair of guide rollers 70 and 72 which align tape from the respective rolls for proper feeding into the channel 64. The channel 64 and the pinch roller 66 and 68 may be covered by a transparent plastic or glass face plate (not shown) to insure that the tape does not slip out during operation. The guide rollers 70 and 72 are supported by struts 74 and 76.

FIGS. 3 and 4 show actual operation of the device. In FIG. 3 the tape 24 from roll 26 is depleted and the trailing end 44 of the tape is about to enter the channel 64. The leading end of the tape 52 is inserted into the channel 64 by the leader portion 53 with the contact paper 60 removed thus exposing the adhesive 58 inside the channel 64 to the tape 24 that is feeding through the splicer 32. The grommet 55 is placed over the pin 31a and the tape 52 is tacked down to the guide roller 72 to hold it in place temporarily. At this point the channel 64 is too wide for the adhesive portion 58 to make effective contact with the tape 24.

FIG. 4 shows the operation of the splicer 32 when the trailing end 44 of the tape 24 enters the channel 64. The channel 64 and in particular, the narrow clearance between pinch rollers 66 and 68 is such that the pinch rollers 66 and 68 will press the adhesive portion 58 against the reinforced thickened portion 46 of the tape 24. The narrowest distance between the pinch rollers 66 and 68 is slightly less than the combined thicknesses of the leading end 50 of the tape 52 and the trailing end 44 of the tape 24. The pinch rollers 66 and 68 are thus dimensioned so that they will pinch the combined thicknesses of the tape portions 58 and 46 together thereby splicing together the two rolls of tape 54 and 26. As the tape splice is pulled through, the leader 53 tears off of the leading end 50 of the new tape roll. This operation is accomplished automatically as the trailing end of a first roll of tape feeds through the splicer 32 in which a second roll of tape has been set up as described above. The channel is wide enough to permit unimpeded feeding of tape until the thickened trailing end enters the channel, so while the first roll is feeding through, the next roll may be prepared.

With the mounting brackets of the invention the splicer 32 may be retrofitted to a wide variety of tape dispensing machines, it being necessary only to properly align the tape for feeding into the machine.

The tape rolls themselves may be prepared in any number of ways, it being necessary only to provide an end having adhesive applied to at least one side and a slightly thicker trailing end that will engage the adhesive once inside the splicer. The use of cardboard as a reinforcing and thickening material is not the only way the trailing end of the tape may be made thicker. Other materials such as plastic may be used, or multiple folds of the tape itself may provide the necessary thickness.

What is claimed is:

1. Apparatus for splicing tape comprising:

(a) first and second rolls of tape, each including a leading end and a trailing end, the leading end including a portion having a adhesive and the trailing end having a reinforced portion of enhanced thickness, (b) said first roll being mounted on a first spindle, (c) said second roll being mounted on a second spindle;

(d) a splicer adapted to receive tape from both said first and second rolls of tape, said splicer including a pair of pinch rollers positioned a predetermined distance apart establishing a channel, tape from said first roll being threaded though said channel, and said leading end of said second roll being threaded though said channel so as to expose said portion having said adhesive within the channel, the channel being dimensioned such that when said reinforced portion of said second roll enters said channel, the pinch rollers press said reinforced portion against said adhesive portion thereby splicing tape from said second roll onto tape from said first roll.

2. The apparatus of claim 1 wherein said splicer is mounted so as to feed tape from said first and second rolls into a tape dispenser.

3. The apparatus of claim 2 wherein said splicer includes a pair of guide rollers, one each of said guide rollers positioned to receive tape from a respective one of said first and second rolls and guide said tape into said channel.

4. The apparatus of claim 1 wherein said splicer comprises a block having mounting brackets for adjustable mounting to a fixture.

5. The apparatus of claim 4 including a mounting apparatus which supports said block and allows the location of said block to be adjusted in vertical and horizontal directions.

6. In combination, a tape dispensing machine, a tape splicer, and first and second rolls of tape, each of said rolls having a leading end and a trailing end, the leading end of each roll having an adhesive portion and the trailing end of each roll having a reinforced portion of enhanced thickness, said tape splicer having a pinch mechanism for pinching said leading end of said first roll of tape against said trailing end of said second roll of tape thereby splicing said first and second rolls of tape together.

7. The combination of claim 6 wherein said tape splicer comprises a block having a channel journalled therein, a pair of pinch rollers adjacent to and protruding into the channel, the spacing between the pinch rollers being slightly less than the combined thicknesses of the leading end of the first roll of tape and the trailing end of the second role of tape.

8. A tape splicer for splicing together first and second rolls of tape comprising a block having a channel for permitting tape to feed through, a pair of pinch rollers adjacent to and protruding into the channel and spaced a predetermined distance apart, and a pair of guide rollers for guiding tape from said first and second rolls of tape into the splicer.

9. The tape splicer of claim 8 further including a bracket comprising an arm which supports said block, the arm having a clamp which is slidably connected to a vertical post for providing vertical adjustment of said block.

10. The splicer of claim 9 wherein said arm includes a pin slidably disposable within an aperture in said block and bolt means for tightening said block onto said pin.

* * * * *